US008485644B2

(12) United States Patent
Nishino

(10) Patent No.: US 8,485,644 B2
(45) **Date of Patent: *Jul. 16, 2013**

(54) INKJET RECORDING APPARATUS

(75) Inventor: Satoshi Nishino, Sayama (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 78 days.

This patent is subject to a terminal disclaimer.

(21) Appl. No.: 13/185,437

(22) Filed: Jul. 18, 2011

(65) Prior Publication Data

US 2011/0273509 A1 Nov. 10, 2011

Related U.S. Application Data

(60) Continuation of application No. 12/859,377, filed on Aug. 19, 2010, now Pat. No. 8,002,388, which is a division of application No. 11/080,410, filed on Mar. 16, 2005, now Pat. No. 7,798,606.

(30) Foreign Application Priority Data

Mar. 19, 2004 (JP) ..... 2004-080972

(51) Int. Cl.
*B41J 2/14* (2006.01)

(52) U.S. Cl.
USPC ..... 347/49

(58) Field of Classification Search
USPC ..... 347/49
See application file for complete search history.

(56) References Cited

U.S. PATENT DOCUMENTS

| | | | | |
|---|---|---|---|---|
| 6,113,215 | A | 9/2000 | Yanagi et al. | |
| 6,536,870 | B1 * | 3/2003 | Takahashi et al. | 347/49 |
| 2002/0008731 | A1 | 1/2002 | Matsumoto et al. | |
| 2002/0024554 | A1 | 2/2002 | Tominaga | |
| 2002/0051033 | A1 | 5/2002 | Kubota et al. | |
| 2004/0041893 | A1 | 3/2004 | Hoshino | |
| 2005/0046058 | A1 | 3/2005 | Suwa et al. | |

* cited by examiner

*Primary Examiner* — Matthew Luu
*Assistant Examiner* — Justin Seo
(74) *Attorney, Agent, or Firm* — Finnegan, Henderson, Farabow, Garrett & Dunner, L.L.P.

(57) ABSTRACT

An inkjet recording apparatus for recording an image by jetting inks in a plurality of colors includes a plurality of recording-head modules for jetting inks in the plurality of colors, and a carriage for mounting the plurality of recording-head modules, wherein each recording-head module includes a plurality of recording heads for jetting ink in the same color and constructs a unit capable of integrally attaching and detaching the plurality of recording heads to and from the carriage.

2 Claims, 7 Drawing Sheets

INKJET RECORDING APPARATUS

CROSS REFERENCE TO RELATED APPLICATIONS

This application is a continuation of application Ser. No. 12/859,377, filed Aug. 19, 2010, now U.S. Pat. No. 8,002,388 which is a divisional of application Ser. No. 11/080,410, filed Mar. 16, 2005, now U.S. Pat. No. 7,798,606 which claims the benefit of priority to Japanese Application No. JP 2004-080972, filed Mar. 19, 2004, the entire disclosures of which are incorporated herein by reference.

FIELD OF THE INVENTION

The present invention relates to an inkjet recording apparatus, and particularly relates to an inkjet recording apparatus which uses ink cured by UV-light irradiation.

BACKGROUND OF THE INVENTION

Conventionally, as means for image recording, which enables easy and inexpensive image recording, inkjet type image printers have been widely used. An inkjet type image printer (hereinafter referred to as 'inkjet recording apparatus') performs image recording on a recording medium such as a paper sheet by jetting ink from the nozzles of recording heads as fine liquid droplets by the use of a piezoelectric element or a heater, and makes the ink penetrate into or fix on the recording medium, while moving the recording heads on the recording medium.

In recent years, as means which allows forming an image even on a recording medium such as a resin film with poor ink absorbance, inkjet recording apparatuses (for example, see Patent Document 1) of a UV-curable type are known. These apparatuses employ a UV-curable ink containing a light initiator having a certain sensitivity to UV-light, and emit UV-light to ink having landed on a recording medium so that the ink is cured and fixed on the recording medium, which makes it possible to easily perform printing even on a transparent or translucent packing material.

Particularly, with regard to an inkjet recording apparatus such as a LF printer for recording on a recording medium with a large width, speeding up of recording is required, and the number of nozzles of a recording head is needed to increase. However, in order to increase the number of nozzles of a recording head, highly advanced production technology and control technology are necessary, and production of such a recording head is difficult. Therefore, usually, plural recording heads are disposed in a staggered fashion to increase the number of nozzles used per scan, thereby improving recording speed.

For example, an apparatus disclosed in Patent Document 2 is provided with a plurality of recording heads on a carriage, wherein the positions of the respective recording heads are adjusted in a state that the recording heads are already mounted on the carriage, which has no problems in a case where the number of recording heads mounted on the carriage is small.

[Patent Document 1] TOKKAI No. 2001-310454

[Patent Document 2] TOKKAI No. 2003-211638

However, if the number of recording heads to be mounted on a carriage is increased, it is necessary to fit an increased number of recording heads on the carriage. Accordingly, the number of adjustment members including a wiring substrate mounted on the carriage and the number of adjustment processes including position adjustment of recording heads after being mounted on the carriage increase. Attaching/detaching of recording heads to/from a carriage for delivery or repair and an accompanying adjustment task take time. Further, it is necessary to do these tasks in a narrow space, which makes the tasks more difficult and takes time.

SUMMARY OF THE INVENTION

The present invention has been devised, considering problems as described above. An object of the invention is to provide an inkjet recording apparatus having pluralities of recording heads on a carriage for jetting inks in respective colors, each plurality of recording heads jetting ink in the same color. With this inkjet recording apparatus, even in a case of increasing the number of recoding heads for jetting ink in the same color, attaching and detaching task of the recording heads on the carriage and an accompanied adjustment task are made easy, and the working time is shortened. The apparatus, not only improves usability as mentioned above, but also achieves highly precise images.

In an aspect in accordance with the invention, an inkjet recording apparatus for recording an image by jetting inks in a plurality of colors includes a plurality of recording-head modules for jetting inks in the plurality of colors, and a carriage for mounting the plurality of recording-head modules, wherein each recording-head module includes a plurality of recording heads for jetting ink in the same color and constructs a unit capable of integrally attaching and detaching the plurality of recording heads to and from the carriage.

PREFERRED EMBODIMENTS OF THE INVENTION

Preferred embodiments in accordance with the invention will be described below, referring to FIGS. 1 to 7. However, the scope of the invention is not limited to the shown examples, and it is understood that various modifications may be made without departing from the spirit of the invention.

[First Embodiment]

Figure 1:
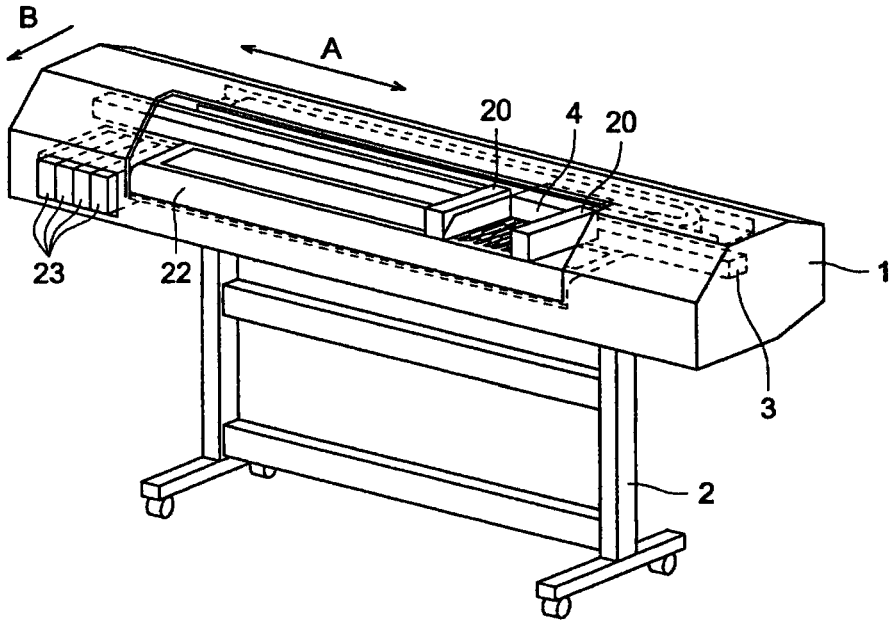
FIG. 1 is an isometric view showing an embodiment of an inkjet recording apparatus in accordance with the invention.

FIG. 1 shows an inkjet recording apparatus in a first embodiment in accordance with the invention. The inkjet recording apparatus in the present embodiment is a serial head type inkjet recording apparatus including a printer body 1 and a support 2.

A bar-shaped guide rail 3 is arranged inside the printer body 1, and the guide rail 3 supports a carriage 4. The carriage 4 is reciprocally moved by a carriage driving device, not shown, along the guide rail 3 in a main scanning direction A which is the lateral direction of a recording medium.

Figure 2:
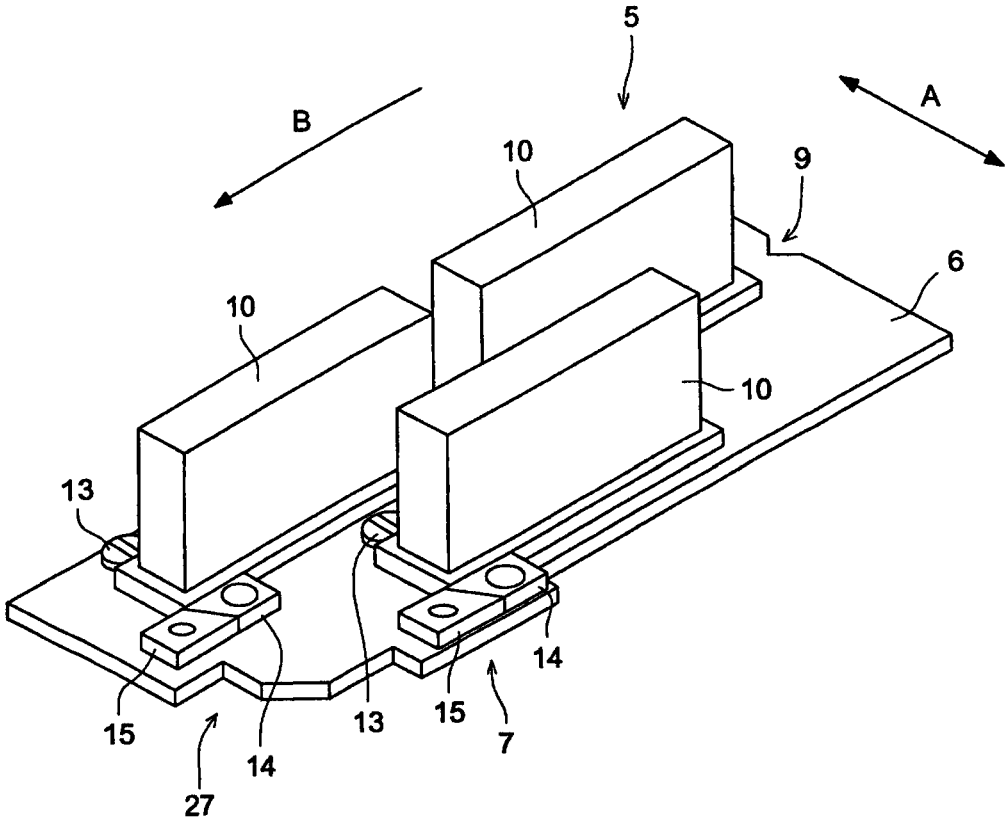
FIG. 2 is an isometric side view of a module unit mounted on a carriage of the inkjet recording apparatus shown in FIG. 1.
Figure 3:
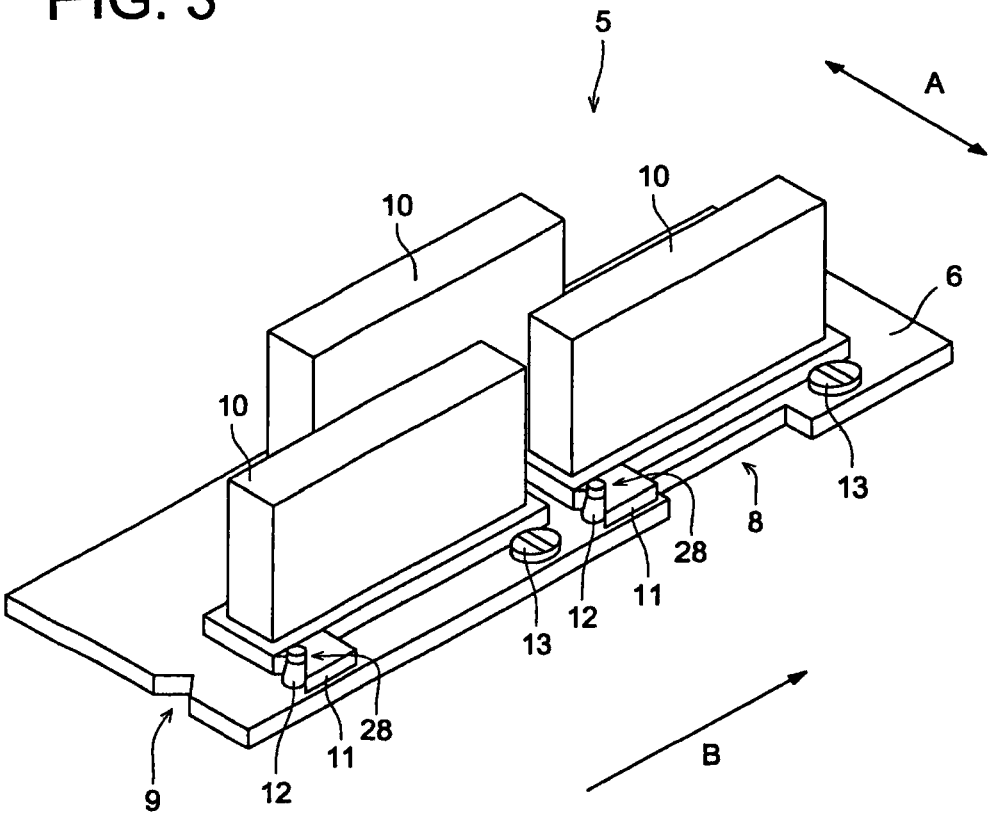
FIG. 3 is another isometric side view of the module unit mounted on the carriage of the inkjet recording apparatus shown in FIG. 1.
Figure 4:
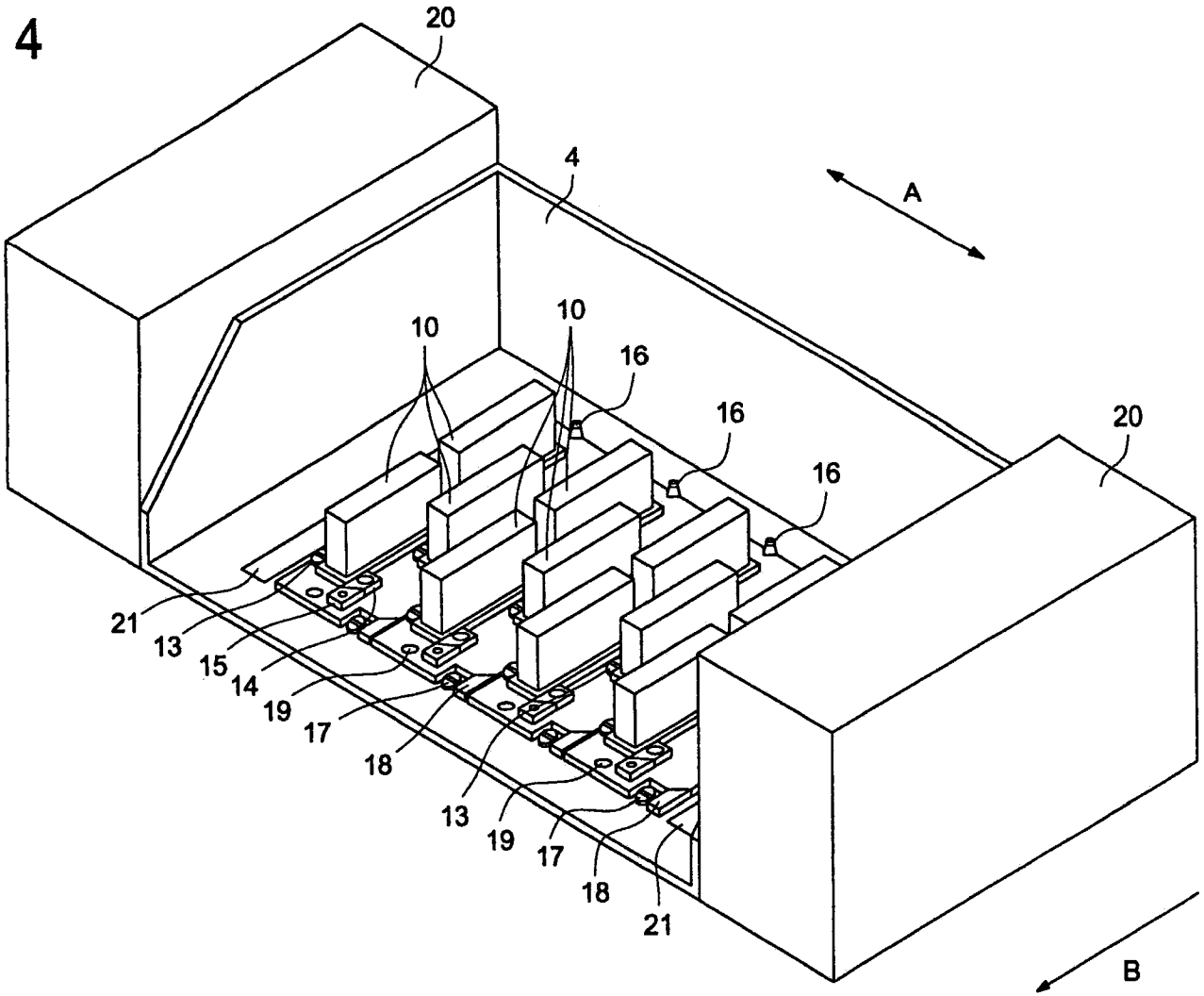
FIG. 4 is an isometric view showing the entire carriage.
Figure 5:
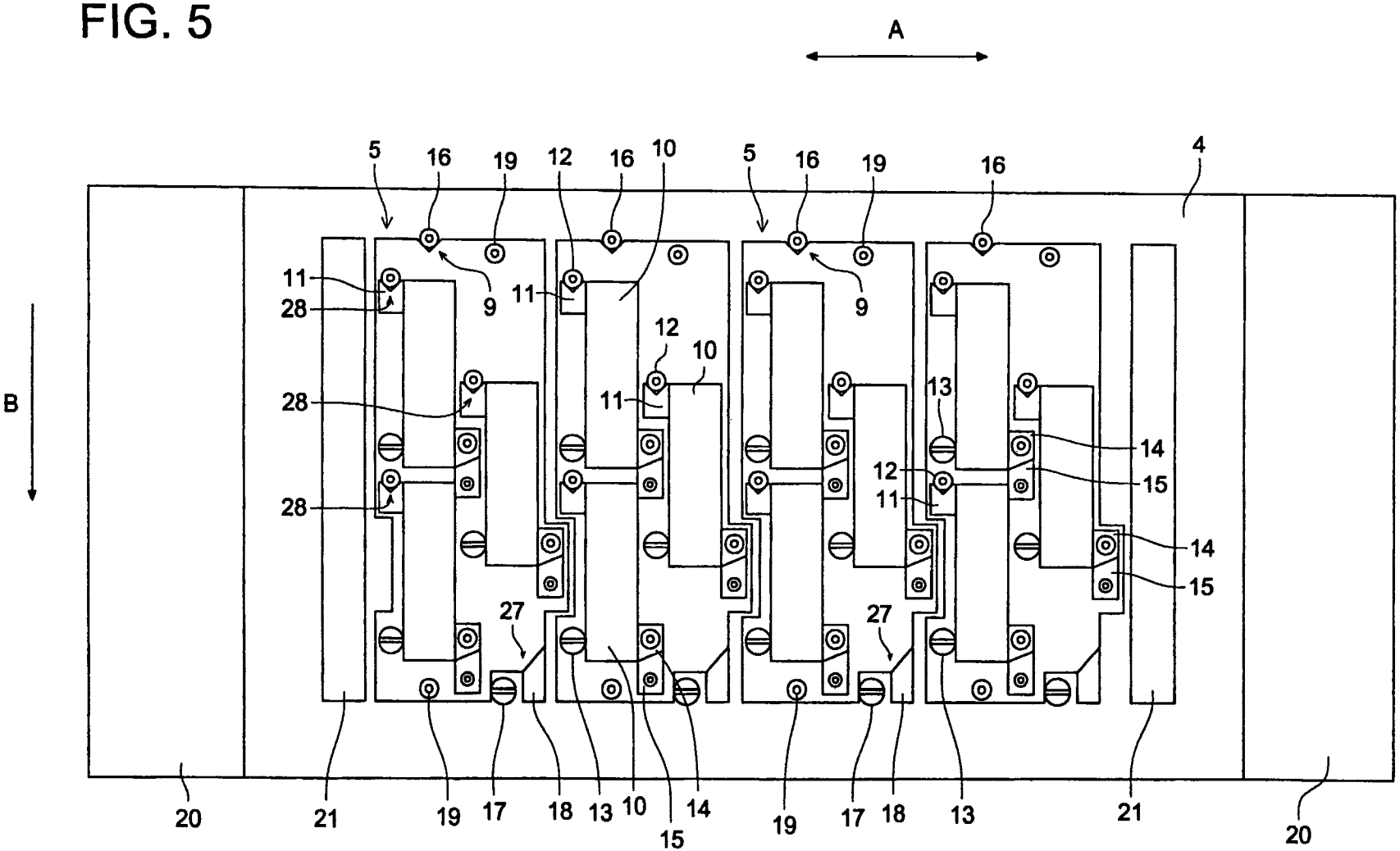
FIG. 5 is a plan view of the entire carriage in a state where module units are installed.

On the carriage 4, there are mounted a plurality of module units 5 as shown in FIGS. 2 and 3 along the main scanning direction A, in the order of colors yellow (Y), magenta (M), cyan (C), and black (K) in such a manner that the longitudinal direction of the module units 5 is the same as a sub scanning direction B orthogonal to the main scanning direction A (see FIGS. 4 and 5).

Each module unit 5 is provided with a module base 6 formed in a thin plate shape. A protrusion 7 is formed on one side surface, along the sub scanning direction B, of the module base 6 (see FIG. 2), and a recess 8 is formed on the other side surface along the sub scanning direction B at a position facing the protrusion 7 of a neighboring module base (see FIG. 3). A V-shaped recess 9 is formed on the side surface of the module base 6, the side surface being parallel to the main scanning direction A and at the upstream end in the sub scanning direction B. A recess 27 is formed at one corner of the end, opposite to the recess 9, in the sub scanning direction B. A portion of the side surface, the side surface being a part of the recess 27 and parallel to the main scanning direction A, is formed with an angle of 45 degrees from the longitudinal direction of the module base 6.

On each module base 6, a plurality of recording heads 10 which jet ink in the same color are disposed with their longitudes along the sub scanning direction B in a staggered fashion. Each recording head 10 is provided with a plurality of nozzles along the sub scanning direction B, not shown, for jetting ink. Three units of recording heads 10 are mounted on each module base 6 in the present embodiment.

Further, as shown in FIG. 3, one side surface of each recording head 10, the side surface being parallel to the sub scanning direction B, is fitted with a positioning member 11 having a V-shaped recess 28, on its portion upstream in the sub scanning direction B.

At a position facing the V-shaped recess 28, a front-end reference pin 12 is provided on the module base 6, protruding from the base, wherein the pin 12 and the recess 28 engage with each other. The pin 12 is tapered toward the end tip on the protruding side and arranged to be movable to the protruding direction and to the opposite direction which is the direction toward the top surface of the module base 6. By moving the front-end reference pin 12 to the protruding direction in a state where the tapered portion of the pin 12 is engaged with the positioning member 11 integrated with the recording head 10, the recording head 10 can be moved slightly to the sub scanning direction B. By moving the front-end reference pin 12 in the direction toward the top surface of the module base 6, the recording head 10 can be moved slightly opposite to the sub scanning direction B. By adjusting the position of the front-end reference pin 12 relative to the module base 6 in the directions opposite to and toward the top surface in this manner, the position of the recording head 10 in the sub scanning direction B is set, thereby finely adjusting the position of the recording head 10 in the sub scanning direction B.

Further, an eccentric rotatable plate 13 is fitted on the module base 6 at its portion downstream in the sub. scanning direction B, in contact with one side surface of the recording head 10, the side surface being parallel to the sub scanning direction B. The eccentric rotatable plate 13 is a plate of which central axis is eccentric. The eccentric plate 13 may be an eccentric pin. The eccentric rotatable plate 13 is fitted rotatably with respect to the top surface of the module base 6. By rotating the eccentric rotatable plate 13 in a state that the eccentric rotatable plate is in contact with the side surface of the recording head 10, the recording head 10 can be moved slightly in the main scanning direction A, according to the eccentric amount. In such a manner, by adjusting the distance between the axis of the eccentric rotatable plate 13 and the recording head 10, the position of the recording head 10 in the main scanning direction A can be finely adjusted. Herein, a trench, not shown, is formed around the side surface of the eccentric rotatable plate 13. A leaf spring, not shown, or the like is fitted in the trench to press against the eccentric rotatable plate 13 so that the eccentric amount of the eccentric rotatable plate 13 is held.

On the downstream side in the sub scanning direction B of the other side surface of the recording head 10, the side surface being parallel to the sub scanning direction B, a plate-shaped fixing member 14 is fitted integrally with the recording head 10. A side surface of the fixing member 14, the side surface being on the downstream side in the sub scanning direction B, is formed at an angle of 45 degrees from the side surface of the recording head 10. At a position on the module base 6, the position facing the side surface of the fixing member 14 and the side surface being on the downstream side in the sub scanning direction B, there is provided a press-fixing member 15 formed correspondingly to the side surface of the fixing member 14. The press-fixing member 15 presses against the fixing member 14 to fix it. The press-fixing member 15 presses against the fixing member 14 integrated with the recording head 10 of which position having been finely adjusted by the front-end reference pin 12 and the eccentric rotatable plate 13. In this manner, the recording head 10 is pressed by a force in both the main scanning direction and the sub scanning direction. Thus, the position of the recording head 10 is set and fixed on the module base 6.

The respective recording heads 10 are fixed to the module base 6 in a state where the positions are adjusted in terms of the disposed direction of respective nozzle rows, nozzle pitches between the respective recording heads 10, and the like, and thereby, the module base 6 having the plurality of recording heads 10 mounted thereon functions as a single recording head.

The recording heads 10 of which positions having been adjusted are further fixed on the module base 6 by a plurality of fixing screws, not shown.

Thus, a module unit 5 is constructed by a module base 6, recording heads 10 mounted on the module bases 6, positioning members 11 for fine adjustment of the positions of the recording heads 10, front-end reference pins 12, eccentric rotatable plates 13, fixing members 14, and press-fixing members 15.

As shown in FIG. 5, on the upstream side of the carriage 4 in the sub scanning direction B, there are provided four protruding front-end reference pins 16 similar to the front-end reference pins 12 provided on the module bases 6. Each front-end reference pin 16 engages with a recess 9 formed on a module base 6, and a mechanism finely adjusts the position of a module unit 5 in the sub scanning direction B, the mechanism being similar to a positioning member 11 mounted on the module base 6 and a V-shaped recess 28.

Further, on the downstream side of the carriage 4 in the sub scanning direction B, there are provided four eccentric rotatable plates 17. The eccentric plates 17 may be eccentric pins. Each eccentric rotatable plate 17 is engaged with a portion of the side surface which forms a part of the recess 27 of a module unit 5, the side surface being parallel to the sub scanning direction B. The eccentric rotatable plate 17 functions similarly to an eccentric rotatable plate 13 provided on the module base 6. In mounting the module unit 5 on the carriage 4, and in a state where the position of the module unit 5 in the sub scanning direction B is fixed by the front-end reference pin 16, the eccentric rotatable plate 17 is engaged with the recess 27 of the module base 6 to move the position of the end of the module unit 5 in the main scanning direction A, the end of the module unit 5 being on the downstream side in the sub scanning direction B. Thus, the position of the module unit 5 in the main scanning direction A is finely adjusted. Herein, similar to the case of each eccentric rotatable plate 13, a leaf spring or the like is fitted in a trench formed around the side surface of the plate 17 to press against the eccentric rotatable plate 17 so that the eccentric amount of the eccentric rotatable plate 17 is held.

Still further, at a position on the carriage 4, the position facing the portion of the side surface of the module unit 5, the side surface having an angle of 45 degrees from the longitudinal direction of the module 5 and forms a part of the recess 27 of the module unit 5, there is provided a press-fixing member 18, correspondingly to the side surface of the module unit 5. The press-fixing member 18 presses against the module unit 5 to fix it. Similarly to the case of the press-fixing member 15 provided on the module base 6, the press-fixing member 18 presses against the module unit 5 in a state where the position of the module unit 5 is adjusted by the front-end reference pin 16 and the eccentric rotatable plate 17 so that the module unit 5 is pressed in both the scanning direction A and the sub scanning direction B. Thus, the position of the module unit 5 is set and fixed on the carriage 4.

Yet further, the respective module units 5 are fixed by a plurality of fixing screws 19 on the carriage 4.

On each side portion, orthogonal to the main scanning direction A, of the carriage 4, a UV-light emitting device 20 is provided. Each UV-light emitting device 20 emits light to ink jetted from nozzles to the recording medium P so that the ink is cured. Inside each UV-light emitting device 20 along the sub scanning direction B, there is provided a UV-light source, not shown, and a reflecting member, not shown, for reflecting UV-light emitted from the UV-light emitting device. Herein, each UV-light emitting source in the present embodiment is a high-pressure mercury lamp, but any kind of light source is applicable, including a low-pressure mercury lamp, metal halide lamp, hot cathode laser tube, cold cathode laser tube, and LED, according to the structure of an inkjet recording apparatus.

Between each UV-light emitting device 20 and the neighboring module unit 5, there is provided a light trap 21 for preventing UV-light, emitted from the UV-light emitting device 20 and reflected by the recording medium or the like, from entering the vicinity of recording heads 10. The light trap extends along the sub scanning direction B and is formed in a box-shape opened toward the recording medium. Inner surfaces of the light trap 21 are UV-light receiving surfaces for receiving reflected light emitted from the UV-light emitting device 20 and reflected by the recording medium or the like.

The central area of the area in which the carriage 4 can move is a recording area where recording is performed on a recording medium P. In the recording area and under the carriage 4, a platen 22 is arranged to support the recording medium at the recording face, the platen 22 being made of a flat-plate material.

Further, at one outer end of the recording area, the outer end being within the area in which the carriage 4 can move, ink tanks 23 for supplying inks in respective colors to the carriage 4 through ink supply paths, not shown, are provided.

Ink to be used in the present embodiment will be described below. In general, a polymerizable compound included in ink is subjected to polymerization reaction in curing the ink. Inks to be used in the present embodiment contain an activation energy curable compound. They are UV-curable inks for which UV-light is employed as activation energy to initiate polymerization reaction.

UV-curable inks can be roughly categorized into radical curable inks containing a radical polymerizable compound and cation curable inks containing a cation polymerizable compound, both of which are applicable as ink to be used in the present embodiment. Further, a hybrid type ink in combination of a radical curable ink and a cation curable ink may be employed as ink to be used in the present embodiment.

However, cation curable inks are inhibited by oxygen from polimarization reaction little or virtually not, and advantageous in functionality and generality. Therefore, cation curable inks are particularly used in the present embodiment. Specifically, cation curable inks employed in the present embodiment are mixture containing, at least, a cation curable compound such as an oxetan compound, epoxy compound, vinyl ether compound, a light cation initiator, and a colorant, having a characteristic of being cured by exposure to the above described UV-light.

The viscosity of inks used in the present embodiment is 10 to 50 mPa·s and the surface tension is 20 to 40 mN/m at a temperature of 25° C., which means the inks have a high viscosity and a low wettabllity.

As a recording medium P used in the present embodiment, it is possible to apply materials including various paper such as plain paper, recycled paper, and, glossy paper, various cloths, various nonweave cloths, resins, metals, glasses. The shape of the recording medium P can be, for example, a roller form, cutsheet form, or plate form.

Still further, as a recording medium P used in the present embodiment, it is also possible to apply known opaque recording media including various paper sheets of which surface is covered with a resin, films containing pigment, and foaming films.

Next, operations and functions in the present embodiment will be described below.

Before using the inkjet recording apparatus, module units 5 are to be fitted on a carriage 4 having no recording heads mounted yet thereon.

First, the positions of a plurality of recording heads 10 for jetting ink in the same color, the recording heads being mounted on a module base 6, are finely adjusted in the sub scanning direction B by positioning members 11 and front-end reference pins 12. Then, the positions of the recording heads 10 are finely adjusted in the main scanning direction A by eccentric rotatable plates 13. In this state, press-fixing members 15 press against respective fixing members 14 to fix the respective recording heads, thereby assembling a module unit 5.

Figure 6:
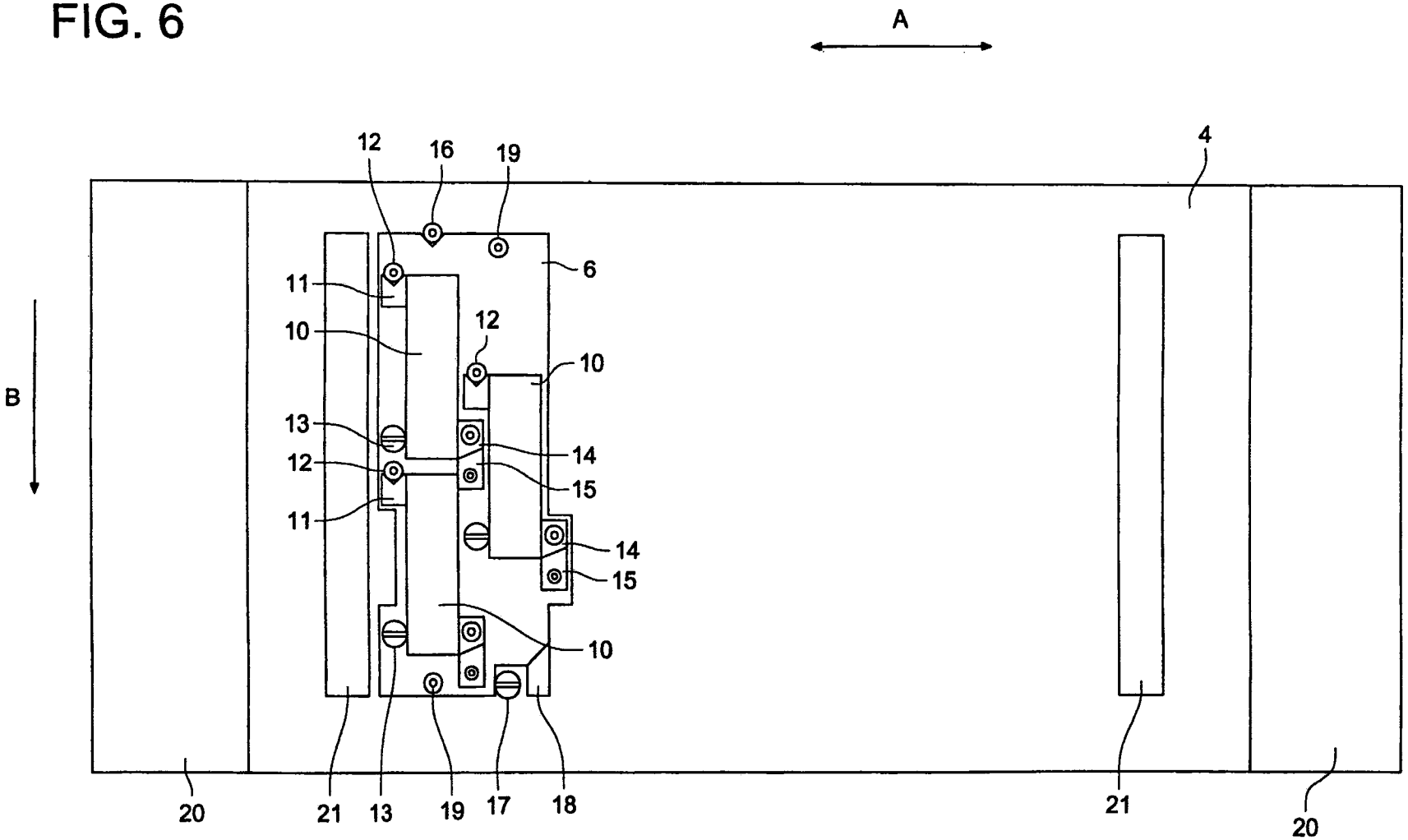
FIG. 6 is a plan view of the entire carriage in a state where a single module unit is fitted.

Each module unit 5 for a respective color, the positions of recording heads thereon having been adjusted in the above-described manner, is mounted on the carriage 4, as shown in FIG. 6, and the position of the module unit 5 in the sub scanning direction B is finely adjusted by a recess 9 and a front-end reference pin 16. Then, in the state where the position of the module unit 5 in the sub scanning direction B is fixed, the position of the module unit 5 in the main scanning direction A is finely adjusted by an eccentric rotatable plate 17, and a press-fixing member 18 presses against the module unit 5 to fix it. Likewise, all the module units 5 are fitted on the carriage 4 (see FIG. 5).

When certain image information has been transmitted to the inkjet recording apparatus, and a recording medium P has been conveyed to a predetermined position in a recording area in response to the image information, the carriage 4 moves into the recording area along a guide rail 3 and starts reciprocal motion just above the recording medium.

Then, during when the carriage 4 is moving, recording heads 10 are operated, according to the image information, to jet ink from the respective nozzles toward the recording medium P, and UV-light is emitted from a UV-light emitting device 20 toward the recording medium P to cure the ink. Herein, UV-light having been emitted from the UV-light emitting device 20 on the downstream side from the recording heads 10, the side being in the moving direction of the carriage 4, instantly cures the ink having been jetted from the recording heads 10 to be fixed on the recording medium.

Then, the inkjet recording apparatus repeats the above respective operations to form an image on the recording medium.

Next, effects of the present embodiment will be described.

In the inkjet recording apparatus in the present embodiment, a module unit 5 integrally having a plurality of recording heads 10 for jetting ink in the same color is mounted as a unit on the carriage 4. In such a manner, it is possible to mount the plurality of recording heads 10 for jetting ink in the same color on the carriage 4 at a time. Accordingly, even in the case where the number of recording heads 10 for jetting ink in the same color to be mounted on the carriage 4 is increased, adjustment members to be mounted on the carriage 4 and an adjustment process on the carriage 4 at the time of delivery or repair can be omitted.

Further, the positions of the plurality of recording heads 10 for jetting ink in the same color are adjusted in advance by a unit of module unit 5, and then each module unit 5 with the recording heads 10 of which positions having been adjusted in the module unit are fitted to the carriage 4. Therefore, in fitting recording heads 10 on the carriage 4 at the time of delivery or replacement, an adjustment process of adjusting the positions of the plurality of recording heads for jetting ink in the same color can be omitted.

Still further, the positions of module units 5 are adjusted on the carriage 4 and fitted to it, and thus the positions of recording heads 10 for jetting inks in different colors are adjusted. Therefore, in fitting recording heads 10 on the carriage 4 for delivery or replacement for example, an adjustment process, on the carriage 4, of adjusting the positions of recording heads 10 for jetting inks in different colors can be omitted.

Yet further, recording heads 10 are disposed in a staggered fashion, and thus more than two recording heads 10 can be disposed in a width for two recording heads 10 on a module unit 5. Therefore, more than two recording heads 10 can be mounted without increasing the width of the module unit 5. Accordingly, by mounting such module units 5 on the carriage 4, more than two recording heads for jetting inks in the respective same colors can be mounted on the carriage 4 without increasing the width of the carriage 4, thereby reducing the space for recording heads 10 on the carriage 4.

Further, in replacing recording heads 10, they are replaced as an integrated module unit 5 including them. Therefore, compared with the case of replacing recording heads 10 one by one, the number of working processes in mounting and dismounting recording heads 10 can be reduced. Also, an adjustment process of adjusting the positions of the respective recording heads 10 after fitting them on the carriage 4 can be omitted, and thus a replacing work can be made easy, thereby the time required by the work being greatly reduced.

As stated above, with the inkjet recording apparatus in the present embodiment, even in a case where pluralities of recording heads 10 for jetting inks in the respective same colors are provided on the carriage 4 and the number of recording heads 10 for jetting ink in the same color is increased, it is possible to reduce the number of adjustment members including a wiring substrate to be mounted on the carriage 4, and to reduce the number of adjustment processes of adjusting the positions of recording heads 10 on the carriage 4. Therefore, at the time of delivery and repair, attaching and detaching work and adjusting work accompanying it on the carriage 4 are made easy to shorten the working time, thus improving usability and achieving highly precise images.

Incidentally, in the present embodiment, each module unit 5 is assembled such that the positions of recording heads 10 in the module unit 5 are adjusted in the module unit 5, and then the module unit 5 is fitted to the carriage 4. However, module units 5, as commercially available module units, having recording heads 10 of which positions in the respective module units have been adjusted already may be fitted to the carriage 4. In this case, working time to fit recording heads 10 on the carriage 4 can be further shortened.

[Second Embodiment]

Next, an inkjet recording apparatus in a second embodiment of the invention will be described below, referring to FIG. 7. The second embodiment is different from the first embodiment only in the structure of module units 5, and others elements are similar to those in the first embodiment. Module units 25 will be mainly described in the second embodiment, by giving the same reference symbols to elements similar to those in the first embodiment and omitting detailed description of them.

Figure 7:
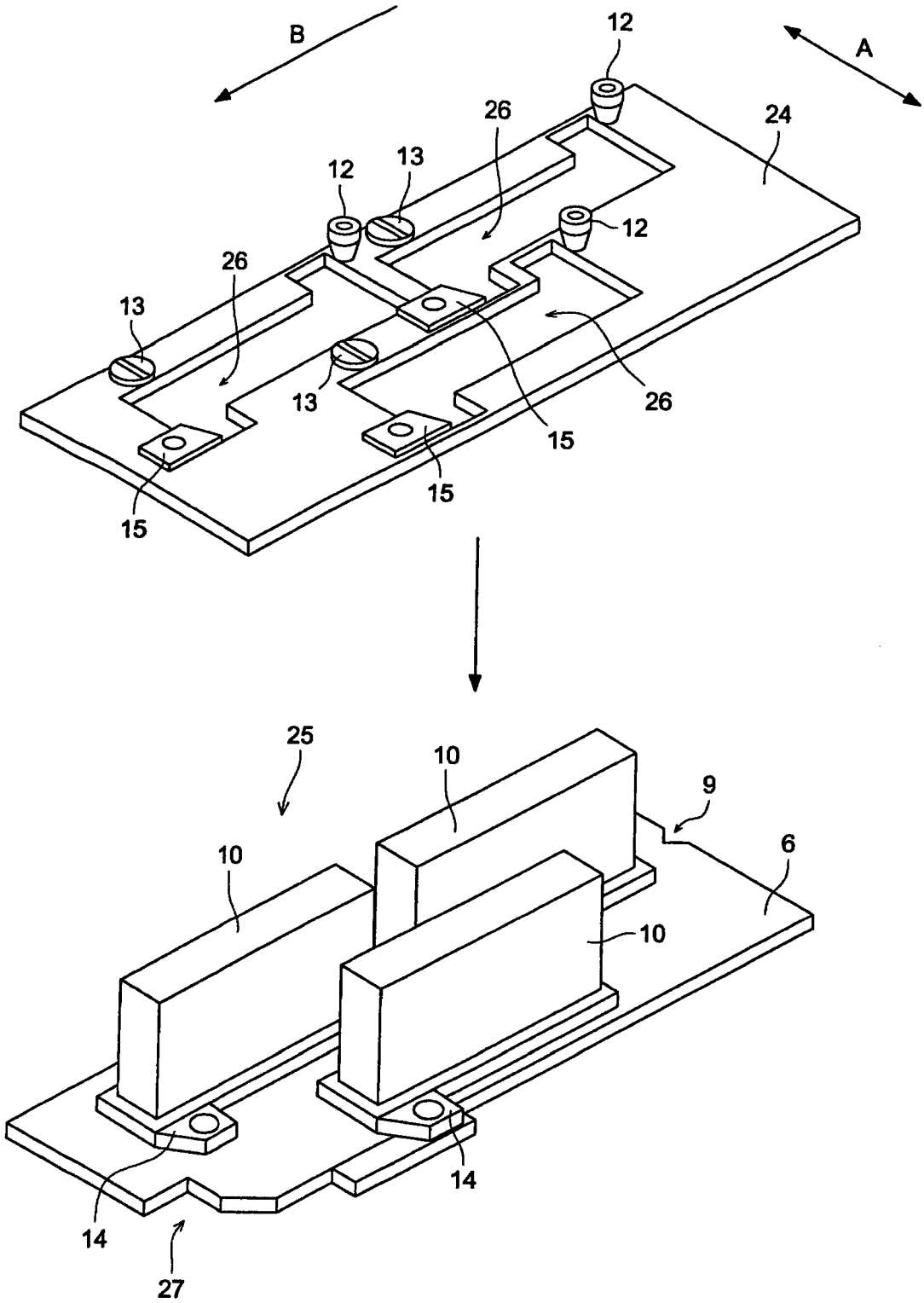
FIG. 7 is an isometric view showing a module unit without an adjustment mechanism and showing an adjustment jig.

As shown in FIG. 7, each module unit 25 includes a module base 6. On the module base 6 are provided recording heads 10, positioning members 11 and fixing members 14, both of which are integrated with the respective recording heads, similarly to a module unit 5 in the first embodiment. Thus, each module unit 25 is structured. On the module unit 25, there is provided an adjustment jig 24 for adjusting the positions of the recording heads 10 mounted on the module base 6.

The adjustment jig 24 is formed with three holes 26 through which the respective recording heads 10, positioning members 11 and fixing members 14 can penetrate. The adjustment jig 24 is mounted on the top surface of the module base 6 so that the recording heads 10, positioning members 11, and fixing members 14, which are protruded portions of the module unit 25, can be protruded through the respective holes 26. Herein, the holes 26 are formed a little larger than the protruded portions of the module unit 25, thereby securing an enough space to perform fine adjustment of the positions of the recording heads 10 with the adjustment jig 24.

Further, front-end reference pins 12, which engage with the respective positioning members 11 when the adjustment jig 24 is mounted, are arranged protruding from the adjustment jig 24 at the respective positions which face the positioning members 11 provided integrally with the respective recording heads 10, wherein the front-end reference pins 12 and respective V-shaped recesses 28 engage with each other. Each front-end reference pin 12 is tapered toward the end tip on the adjustment jig 24 side, which is opposite to the protruding side, and arranged movable to the protruding direction and to the direction toward the top surface of the adjustment jig 24. By moving the pin 12 to the protruding direction in a state where the tapered portion of the pin 12 is engaged with the positioning member. 11 integrated with the recording head 10, the recording head 10 can be moved slightly to the direction opposite to the sub scanning direction B. By moving the front-end reference pin 12 to the direction toward the top surface of the adjustment jig 24, the recording head 10 can be moved slightly to the sub scanning direction B. Similarly to the first embodiment, by adjusting the position of a front-end reference pin 12 to the protruding direction and to the direction toward the top surface of the adjustment jig 24 in this manner, the position of a recording head 10 in the sub scanning direction B is set, thereby finely adjusting the position of the recording head 10 in the sub scanning direction B.

Still further, on the adjustment jig 24, eccentric rotatable plates 13 are provided such that each plate 13 comes in contact with one side surface of a recording head 10, the one side surface being parallel to the sub scanning direction B and on the downstream side in the sub scanning direction B. Similarly to the first embodiment, in a state where an eccentric rotatable plate 13 is in contact with the side surface of a recording head 10, by setting the distance between the axis of the eccentric rotatable plate 13 and the recording head 10, the position of the recording head 10 in the main scanning direction A can be finely adjusted.

Yet further, on the adjustment jig 24, press-fixing members 15 are provided at respective positions facing the side surfaces, on the downstream side in the sub scanning direction B, of the respective fixing members 14 on the module base 6, wherein the press-fixing members 15 are formed correspondingly to the above-described side surfaces of the respective fixing member 14. Through a fixing member 14, each press-fixing member 15 presses against a recording head 10 of which position having been finely adjusted by the front-end reference pin 12 and the eccentric rotatable plate 13 so that the recording head 10 is pressed by a force in both the main scanning and sub scanning directions. Thus, the position of each recording head 10 is set on the module base 6 and fixed.

Similarly to the first embodiment, the respective recording heads 10 are fixed to the module base 6 in a state where the positions are adjusted in terms of the disposed directions of respective nozzle rows and nozzle pitches between the respective recording heads 10, and thereby, the module base 6 having the plurality of recording heads 10 mounted thereon functions as a single recording head.

Further, the recording heads 10 of which positions having been adjusted are fixed to the module base 6 by a plurality of fixing screws, not shown.

In such a manner, instead of the module unit 25 itself being provided with members for fine adjustment of the positions of recording heads 10, the adjustment jig 24 is provided with members for fine adjustment of the positions of the recording heads 10, thus the positions of the recording heads 10 are finely adjusted, and then the module unit 25 on which this position adjustment has been completed is fitted to the carriage 4, similarly to the first embodiment.

Next, operations and functions in the present embodiment will be described.

First, an adjustment jig 24 is mounted on the top surface of a module base 6, and then the positions of a plurality of recording heads 10 for jetting ink in the same color mounted on the module base 6 are finely adjusted in the sub scanning direction B by respective positioning members 11 and front-end reference pins 12. Then, the positions of the recording heads 10 are finely adjusted in the main scanning direction A by eccentric rotatable plates 13. In this state, press-fixing members 15 presses against respective fixing members 14 to position and fix the recording heads 10, and thus a module unit 25 is assembled. Likewise, all module units 25 are assembled.

Next, the module units 25, for respective colors, of which recording heads having been adjusted in position in the above-described manner, are mounted on the carriage 4. In this process, the adjustment jig 24 mounted on a module 25 is removed, thereafter the Module unit 25 is mounted on the carriage 4, and then the position of the module unit 25 in the sub scanning direction B is finely adjusted by a recess 9 and a front-end reference pin 16. Then, in a state where the position of the module unit 25 in the sub scanning direction B is fixed, the position of the module unit 25 in the main scanning direction A is finely adjusted, and then a press-fixing member 18 presses against the module unit 25 to fix it. All the module units 25 are fitted to the carriage 4 in the same manner.

Then, the inkjet recording apparatus operates and forms images on recording media, similarly to the first embodiment.

Next, effects of the present embodiment will be described.

In the inkjet recording apparatus in the present embodiment, a module unit 25 integrally having a plurality of recording heads 10 for jetting ink in the same color is mounted as a unit on the carriage 4, and thus, it is possible to mount the plurality of recording heads 10 for jetting ink in the same color on the carriage 4 at a time. Accordingly, even in the case where the number of recording heads 10 for jetting ink in the same color to be mounted on the carriage 4 is increased, adjustment members to be mounted on the carriage 4 and an adjustment process on the carriage 4 at the time of delivery or repair can be omitted. Thus, the work of attaching and detaching recording heads 10 to be performed on the carriage 4 can be made easy.

Further, the positions of the plurality of recording heads 10 for jetting ink in the same color are adjusted with the adjustment jig 24 in advance by a unit of module unit 25, and then each module unit 25 having the recording heads 10 of which positions in the unit having been adjusted in advance are fitted to the carriage 4. Therefore, in fitting recording heads 10 on the carriage 4 at the time of delivery or replacement, an adjustment process of adjusting the positions of the plurality of recording heads for jetting ink in the same color can be omitted.

Still further, the positions of module units 25 are adjusted on the carriage 4, then the module units 25 are fitted on it, and thus the positions of recording heads 10 for jetting inks in different colors are adjusted. Therefore, in fitting recording heads 10 on the carriage 4, for example, for delivery or replacement, an adjustment process, on the carriage 4, of adjusting the positions of recording heads 10 for jetting inks in different colors can be omitted.

Yet further, recording heads 10 are disposed in a staggered fashion, and thus more than two recording heads 10 can be disposed in a width for two recording heads 10 on a module unit 25. Therefore, more than two recording heads 10 can be mounted without increasing the width of the module unit 25. Accordingly, by mounting such module units 5 on the carriage 4, more than two recording heads for jetting inks in the respective same colors can be mounted on the carriage 4 without increasing the width of the carriage 4, thereby reducing the space for recording heads 10 on the carriage 4.

Further, in replacing recording heads 10, they are replaced as an integrated module unit 25 including them. Therefore, compared with the case of replacing recording heads 10 one by one, the number of working processes in mounting and dismounting recording heads 10 can be reduced. Also, an adjustment process of adjusting the positions of the respective recording heads 10 on the carriage 4 after fitting them can be omitted, and thus replacing work can be made easy, thereby the time required by the work being greatly. reduced.

As stated above, with regard to the inkjet recording apparatus in the present embodiment, even in a case where pluralities of recording heads 10 for jetting inks in the respective same colors are provided on the carriage 4 and the number of recording heads 10 for jetting inks in the same color is increased, it is possible to reduce the number of adjustment members to be mounted on the carriage 4, and to reduce the number of adjustment processes of adjusting the positions of recording heads 10 on the carriage 4. Therefore, at the time of delivery and repair, attaching and detaching work and adjusting work accompanying it on the carriage 4 are made easy to shorten the working time, which improves usability and achieves highly precise images.

Herein, an adjustment jig 24 can finely adjust the positions of recording heads 10 on a module unit 25 having no mechanism for adjusting the positions of the recording heads 10, and further, it is not necessary to provide the module unit 25 itself with members for fine adjustment of the positions of recording heads 10. Thus, mass production of module units 25 with reduced cost can be achieved.

The invention includes the following structures.

(1) An inkjet recording apparatus jets inks in plural colors and includes pluralities of recording heads, each plurality of recording heads being provided for an ink in the same color. The apparatus also includes module units, each module unit having one of the pluralities of recording heads mounted on it for jetting ink in the same color, and a carriage having the module units mounted on it.

According to the above item (1), a plurality of recording heads which jet ink in the same color can be mounted on the carriage by a unit of module unit. Thus, the plurality of recording heads for jetting ink in the same color can be mounted on the carriage by mounting a single module unit.

Therefore, even in a case of increasing the number of recording heads for jetting ink in the same color to be mounted on the carriage, it is possible to omit an adjustment mechanism for adjusting the positions of recording heads to be mounted on the carriage and omit an adjustment process of adjusting the positions of the respective recording heads on the carriage, which would be otherwise required at the time of delivery or repair of the apparatus. Therefore, attaching and detaching work and accompanying adjustment work are easy, which shortens working time, improves usability, and provides highly precise images.

(2) In the inkjet recording apparatus of item (1), each module unit includes a position adjustment mechanism for adjusting the respective positions of the recording heads mounted on the module unit.

According to item (2), the positions of plural recording heads for jetting ink in the same color can be adjusted by a unit of module unit. Further, a module unit having the plural fitted recording heads for jetting ink in the same color can be fitted on the carriage in such a manner that the positions of the respective recording heads have been adjusted in advance.

Therefore, in fitting recording heads for jetting ink in the same color on the carriage, it is possible to omit an adjustment process of adjusting the positions of the plural recording heads on the carriage.

(3) In the inkjet recording apparatus of item (1) or (2), the carriage includes a position adjustment mechanism for adjusting the positions of the module units.

According to item (3), the positions between the module units can be adjusted on the carriage.

Therefore, in fitting module units on the carriage, the positions of the module units are adjusted to be fitted properly, thereby making it possible to omit an adjustment process of adjusting the positions of plural recording heads for jetting different inks.

(4) In the inkjet recording apparatus of any one of items (1) through (3), the recording heads in the respective module units are disposed in a staggered fashion.

According to item (4), even in a case of mounting more than two recording heads on a module unit, they can be disposed within a width for two recording heads, making it possible to mount more than two recording heads without increasing the width of the module unit.

Therefore, by mounting such module units on the carriage, it is possible to mount more than two recording heads without increasing the width of the carriage and save space for recording heads on the carriage.

(5) In the inkjet recording apparatus of any one of items (1) through (4), an integrated recording-head module unit having recording heads mounted on the module unit is replaced in replacing recording heads.

According to item (5), the number of work processes in mounting and dismounting recording heads 10 to and from the carriage 4 can be reduced, compared with a case of replacing the recording heads one by one. Further, it is possible to omit a work process of adjusting the positions of the respective recording heads on the carriage after fitting them.

Therefore, it is possible to make the work of replacement easy and greatly shorten the time required by the work.

(6) In the inkjet recording apparatus of any one of items (1) through (5), the inks have a viscosity of 10 to 50 mPa·s and a surface tension of 20 to 40 mN/m at a temperature of 25° C.

According to item (6), the inks have a high viscosity and a low wettability.

Therefore, it is prevented that ink droplets undesirably spread or ink blurs after the ink has landed on a recording medium. Accordingly, a highly precise image can be obtained on any type of recording medium.

(7) In the inkjet recording apparatus of any one of items (1) through (6), the inks include a compound curable by activation energy, wherein the activation energy is that of UV light.

According to item (7), the inks can be cured efficiently by emitting UV light.

Therefore, no matter what the recording medium is, a highly precise image can be obtained by combining features described in items (1) to (7) even on a recording medium such as a resin film having a low ink absorbance.

What is claimed is:

1. A method of adjusting positions of recording heads of an inkjet recording apparatus which records an image by jetting inks in plural colors on a recording medium, comprising the steps of:

(1) fitting a plurality of recording heads for jetting ink in a same color to a module base to construct a recording-head module for said same color, wherein the recording-head module includes the plurality of recording heads as an integrated unit, and the integrated unit is mounted to the inkjet recording apparatus, adjusting positions of the respective recording heads in a first direction which is a lateral direction of the recording medium and a second direction orthogonal to the first direction on the module base, and making the recording-head module capable of integrally attaching and detaching the plurality of recording heads;

(2) performing step (1) for each of the plural colors other than said same color and constructing a plurality of recording-head modules for the plural colors other than said same color;

(3) mounting the plurality of recording-head modules onto a fitting surface and adjusting positions of the respective recording-head modules in the first direction and the second direction on the fitting surface; and (4) replacing the integrated unit when at least one of the plurality of recording heads is replaced.

2. The recording-head position adjusting method of claim 1, wherein the position adjustment of the recording heads on each module base is performed with a position adjustment mechanism.

* * * * *